US005586465A

United States Patent [19]

Alcini et al.

[11] Patent Number: 5,586,465

[45] Date of Patent: Dec. 24, 1996

[54] PRESS BRAKE CONTROLLER POSITIONING SYSTEM

[76] Inventors: Raymond R. Alcini, 195 Mast St., Morgan Hill, Calif. 95037; Dan E. Ritola, 406 Imboden Rd., Castle Rock, Wash. 98611

[21] Appl. No.: 344,351

[22] Filed: Nov. 22, 1994

[51] Int. Cl.[6] ..... B21J 13/00

[52] U.S. Cl. ..... 72/441; 72/389.3; 74/512; 192/131 H; 200/86.5

[58] Field of Search ..... 72/441, 389, 389.3; 74/512, 560; 192/131 H; 200/86.5; 100/53, 48, 43

[56] References Cited

U.S. PATENT DOCUMENTS

| | | | |
|---|---|---|---|
| 3,943,795 | 3/1976 | Kenney | 74/560 |
| 3,983,344 | 9/1976 | Straihammer | 74/560 |
| 4,131,189 | 12/1978 | Stephens | 192/131 H |
| 5,117,670 | 6/1992 | Sartorio | 72/389 |

FOREIGN PATENT DOCUMENTS

| | | | |
|---|---|---|---|
| 700711 | 12/1940 | Germany | 74/512 |
| 2725 | 1/1989 | Japan | 72/389 |
| 197333 | 8/1990 | Japan | 72/405 |

*Primary Examiner*—Daniel C. Crane

*Attorney, Agent, or Firm*—James J. Leary; Leary, Titus & Aiello

[57] ABSTRACT

A positioning system which mounts onto or in front of a hydraulic press brake or other machinery to reposition the operator controls of the machine laterally and/or longitudinally with respect to the machine. Embodiments are presented which move the foot-operated control pedals and the hand-operated tonnage controller of a hydraulic press brake. In various embodiments, the system is powered by a pneumatic cylinder, a pneumatic motor or an electric motor. Manually actuated switches allow the operator to move the control pedal and/or the tonnage controller to selected positions. A programmable control system and a remote control unit are provided for alternate modes of operation.

23 Claims, 6 Drawing Sheets

PRESS BRAKE CONTROLLER POSITIONING SYSTEM

FIELD OF THE INVENTION

The present invention relates generally to press brakes and related sheet metal forming equipment. More specifically, it relates to a press brake controller positioning system which is adapted to automatically or manually move the control pedals and/or the tonnage controller of a press brake laterally and/or longitudinally with respect to the machine.

BACKGROUND OF THE INVENTION

Many sheet metal parts are produced by bending the sheet metal with a press brake or similar sheet metal forming machine. Press brakes are also sometimes known in the industry as bending brakes, bending presses or pan brakes. Typically, a press brake is a hydraulic press which has a metal die and a metal punch which are shaped to form a particular bend or curve in the sheet metal when the die and punch are pressed together with the sheet metal in-between. Press brakes are available in a wide variety of sizes that range from approximately 1 meter bending length up to 7 meters or more. The different sizes of press brakes can be set up for bending sheet metal parts of different sizes corresponding more or less with the length of the machine. Another technique for utilizing a longer machine is to set up multiple bending stations or stages for bending smaller sheet metal parts along the length of the press brake. The different bending stations can be set up with similar punches and dies for forming a multiplicity of identical parts simultaneously. More advantageously, the press brake can be set up with different punches and dies at each station for progressively forming a complex sheet metal part requiring multiple bending operations.

Whether it is used for bending one large sheet metal part, multiple identical parts or for progressive forming operations, one of the inconveniences of a long press brake is that the press controls, which generally include a foot-operated control pedal and a hand-operated tonnage controller, are not always conveniently accessible to the press brake operator. Typically, the control pedal on these machines is at the end of a long flexible cable so that the pedal can be moved to a convenient position by the operator. The tonnage controller is sometimes mounted on a pedestal above the control pedal so that it can also be moved to a convenient position by the operator. The reality, however, is that the operator's hands are generally occupied with the sheet metal part to be formed so he or she ends up kicking the control pedal along the length of the machine while moving from station to station. This is neither convenient nor efficient. It could also have serious safety consequences if kicking the pedal causes the press to actuate at an inappropriate time or if the operator trips or loses his or her balance while trying to move the control pedal or tonnage controller. It would be desirable, therefore, to provide a way to move the control pedal and/or the tonnage along the length of the press brake from station to station so that it is optimally positioned for convenient use by the press operator at all times.

Some press brakes come equipped with a treadle that spans the front of the machine for operating the brake from any position along its length. This is only a partial solution to the problem because the treadle has a fixed distance away from the front of the press brake. It may be conveniently placed for operating the press while bending small parts, but if the press is used for forming larger sheet metal parts, the operator may have to reach awkwardly forward to the machine with one foot to operate the treadle. A similar inconvenience is experienced by the operator of a hydraulic sheet metal shear when making multiple cuts on a large piece of sheet metal. As the operator makes progressive cuts on the sheet metal, he or she moves closer to the machine while holding the sheet metal part. The optimal control pedal position at the beginning of the operation will be inconvenient by the end of the process and vice versa. If the control pedal is on the end of a flexible cable, the operator will end up pushing or kicking it toward or away from the press or the shear to move it to a convenient operating position. If the machine is equipped with a treadle, it cannot be moved, so it will be awkward to reach whenever large parts are cut or bent. Therefore, it would also be desirable to provide a convenient way to move the controls of a press brake or related sheet metal forming equipment closer or farther away from the machine so that it is optimally positioned for convenient use by the machine operator at all times.

SUMMARY OF THE INVENTION

In keeping with the foregoing discussion, it is an objective of the present invention to provide a system for controlling the position of the operator controls of a piece of sheet metal forming equipment, such as a hydraulic press brake. In one aspect of the invention, the positioning system would be adapted to move the control pedal or pedals of the machinery to the desired position. In a second aspect of the invention, the positioning system can also be adapted to move the hand controls, such as the tonnage controller of the machinery. It is an objective of the invention to provide a positioning system that is adapted to move the operator controls of the sheet metal forming equipment along the length of the machine and/or to move the operator controls closer to and farther away from the machine.

It is a further objective of the invention to provide a system with manually actuated controls for positioning the operator controls of the machine. It is another objective to provide a remote control function which allows the operator to reposition the operator controls from a distance without any direct contact with the machine. Yet another objective of the invention is to provide a system that is programmable for automatically positioning the operator controls of the machine at predetermined positions according to a timed schedule or in response to signals from the machine operator. Thus, the operator will be able to move from station to station on a multi-station forming machine and the operator controls will be optimally positioned for operator convenience at each station.

In accordance with these objectives, the present invention takes the form of a positioning system which mounts onto or in front of a hydraulic press brake or other machinery to reposition the operator controls of the machine laterally and/or longitudinally with respect to the machine. Embodiments are presented which move the control pedals and the tonnage controller of a hydraulic press brake. In various embodiments, the system is powered by a pneumatic cylinder, a pneumatic motor or an electric motor. Manually actuated switches allow the operator to move the control pedal and/or the tonnage controller to selected positions. A programmable control system and a remote control unit are provided for alternate modes of operation.

DETAILED DESCRIPTION OF THE INVENTION

Figure 1:
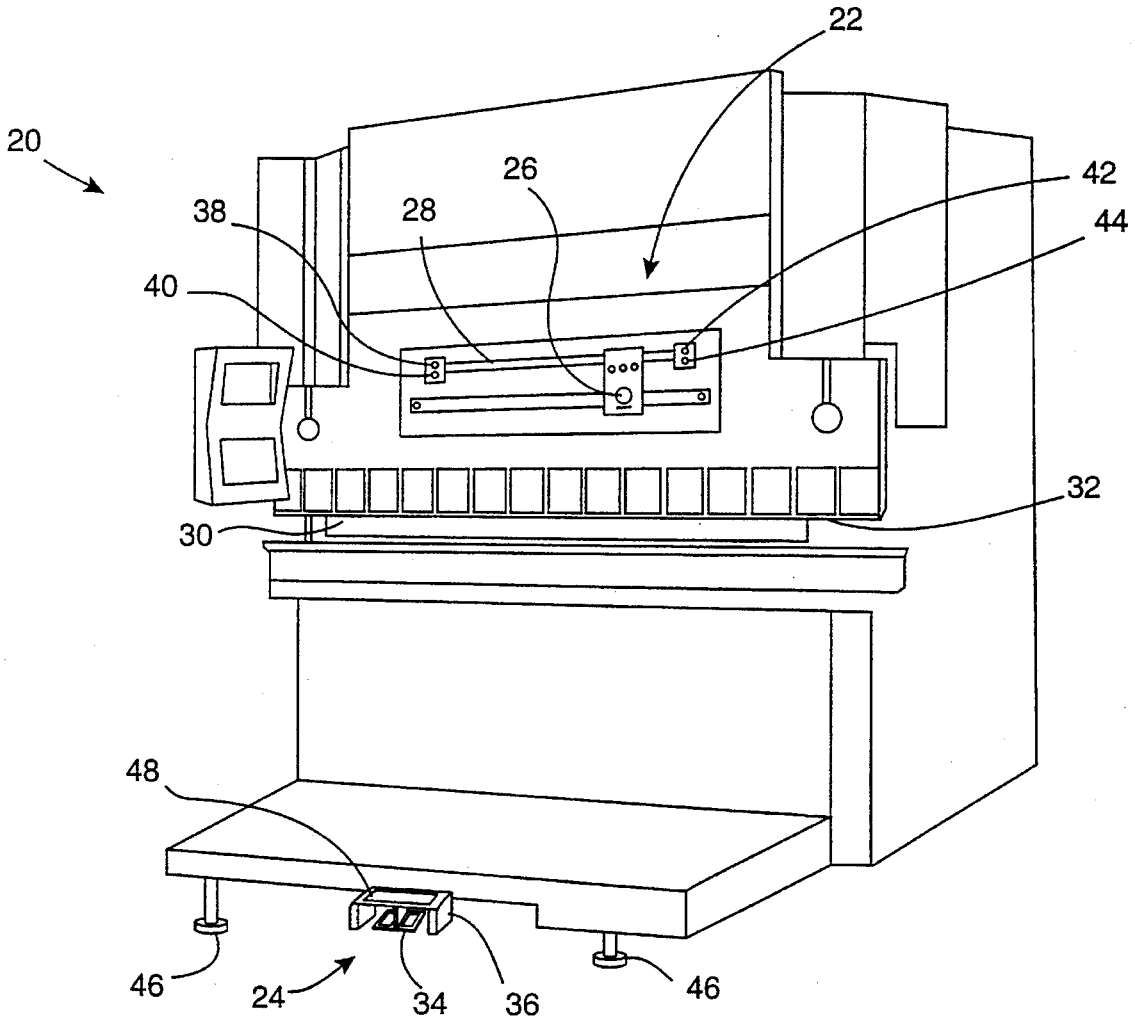
FIG. 1 is a perspective view of a press brake equipped with the press brake controller positioning system of the present invention.

FIG. 1 shows a perspective view of a typical hydraulic press brake 20 with the press brake controller positioning system. 22, 24 of the present invention installed. The controller positioning system in this installation includes an upper controller positioning subsystem 22 and a lower controller positioning subsystem 24. The upper controller positioning subsystem 22 serves to reposition the hand-operated tonnage controller 26 of the press brake. The tonnage controller 26 is slidably mounted on a rail 28 which is fastened to the front of the press brake 20 above the punch 30 and die 32. The tonnage controller 26 is free to move along the length of the press brake 20 so that it can be positioned in a convenient location above the bending station that is in current use. Because the upper controller positioning subsystem 22 holds the tonnage controller 26 within easy reach of the press operator, it is generally not necessary to motorize or automate the upper positioner 22. In the preferred embodiment illustrated the tonnage controller 26 can easily be slid along the rail 28 to the desired position by hand. In other preferred embodiments, it may be desirable to motorize the upper controller positioning subsystem 22, such as with an electric motor or pneumatic motor or cylinder.

The lower controller positioning subsystem 24 can be seen in FIG. 1 mounted in front of the press brake 20 near the floor. The lower controller positioning subsystem 24 serves to position the control pedals 34 which control the opening and closing of the punch 30 and die 32 of the press brake 20. There is a safety guard 36 over the control pedals 34 so that they will not be inadvertently actuated by the press operator. The lower controller positioning subsystem 24 is motorized so that the control pedals 34 can be moved along the length of the press brake 20 to a convenient position below the bending station that is in current use. In is this illustrative embodiment the lower controller positioning subsystem 24 is operated from two sets of control switches, 38, 40 and 42, 44, mounted on the front of the press brake 20 just above the tonnage controller 26 and the upper controller positioning subsystem 22. On the left side of the press brake 20 there is a first button 38 that moves the control pedals 34 to the right and a second button 40 which moves the control pedals 34 to the left. These controls are duplicated 42, 44 on the right side of the press brake 20. The control switches, 38, 40 and 42, 44, are located so that one or the other set of buttons is reachable from any place along the length of the press brake 20 even if the control pedals 34 are out of reach of the operator.

Figure 2:
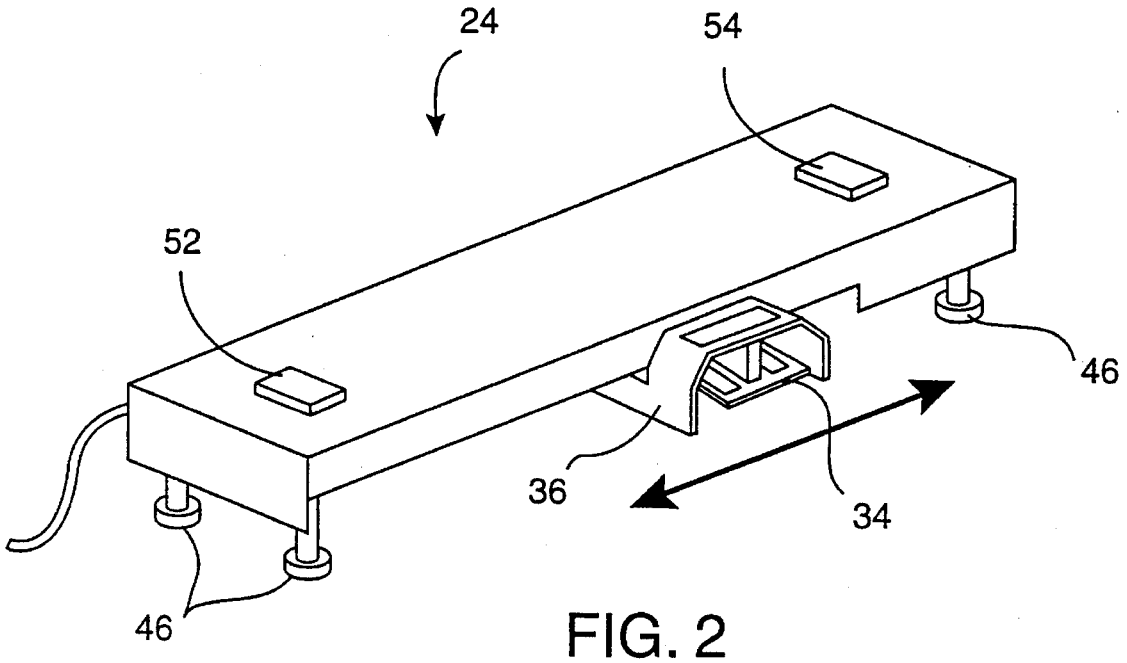
FIG. 2 is a perspective view of a first embodiment of the lower controller positioning subsystem of the press brake controller positioning system.
Figure 3:
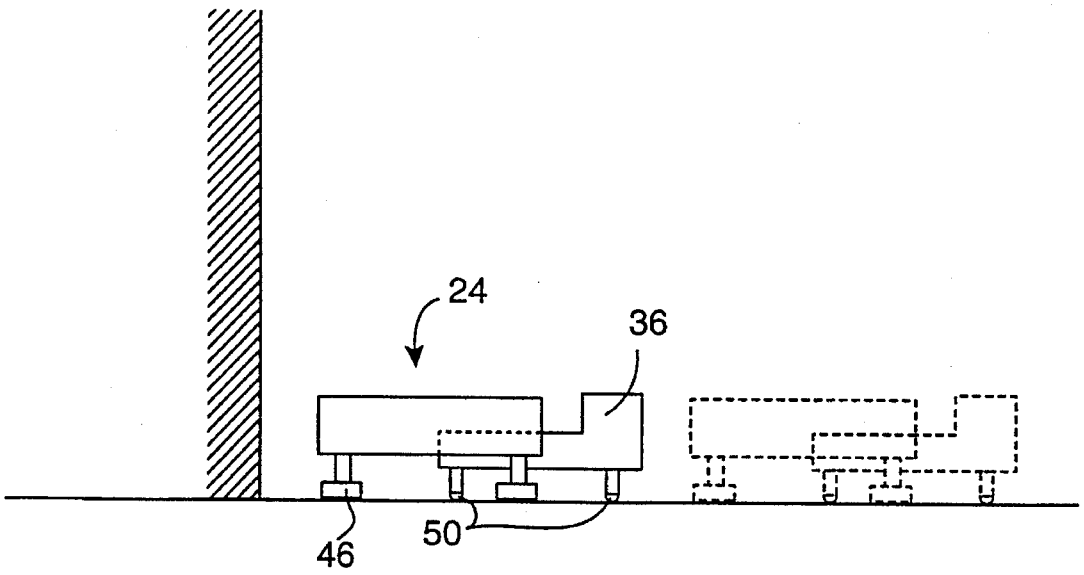
FIG. 3 is a side view of the first embodiment of the lower controller positioning subsystem of FIG. 2.
Figure 4:
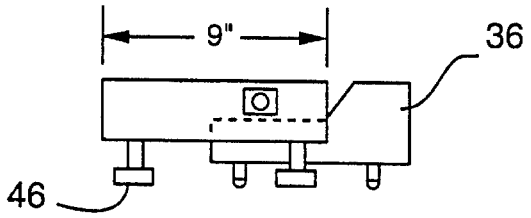
FIG. 4 is a cutaway side view of the first embodiment of the lower controller positioning subsystem.
Figure 5:
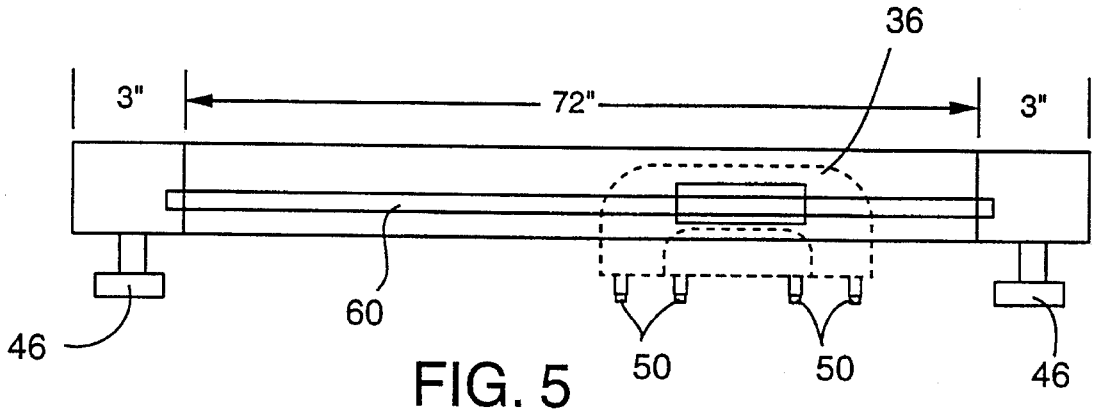
FIG. 5 is a cutaway front view of the first embodiment of the lower controller positioning subsystem.

FIG. 2 shows a close-up perspective view of a first embodiment of the lower controller positioning subsystem 24. The lower controller positioning subsystem 24 in this embodiment is free-standing so that the control pedals 34 can be moved close to the front of the press brake 20, as shown by the solid lines 24 in FIG. 3, when small parts are being formed, and it can be moved farther away from the press 20, as shown in phantom lines 24', when larger parts are being formed on the press. This eliminates the need for the press operator to reach forward awkwardly with one foot to operate the control pedals 34 when forming large parts on the press. It should also be understood that, if desired, the movement of the lower controller positioning subsystem 24 closer to or farther from the press brake 20 can also be automated with the use of pneumatic cylinders or other linear actuators, such as those described below. The controller positioner 24 is supported on four legs 46 that extend downward from a protective sheet metal housing 48 that covers and protects the positioner mechanism. Preferably, each of the four legs 46 is adjustable in length so that the controller positioner 24 can be properly leveled if the shop floor is uneven.

The control pedals 34 and the safety guard 36 ride on ball casters 50 for smooth movement along substantially the whole length of the press brake 20. In this embodiment, the control switches which move the control pedals 34 left and right are foot-operated switches 52, 54 which are mounted on the top of the housing 48. The control switches 52, 54 are located so that one or the other footswitch is reachable from any place along the length of the press brake 20 even if the control pedals 34 are out of reach of the operator.

Figure 12:
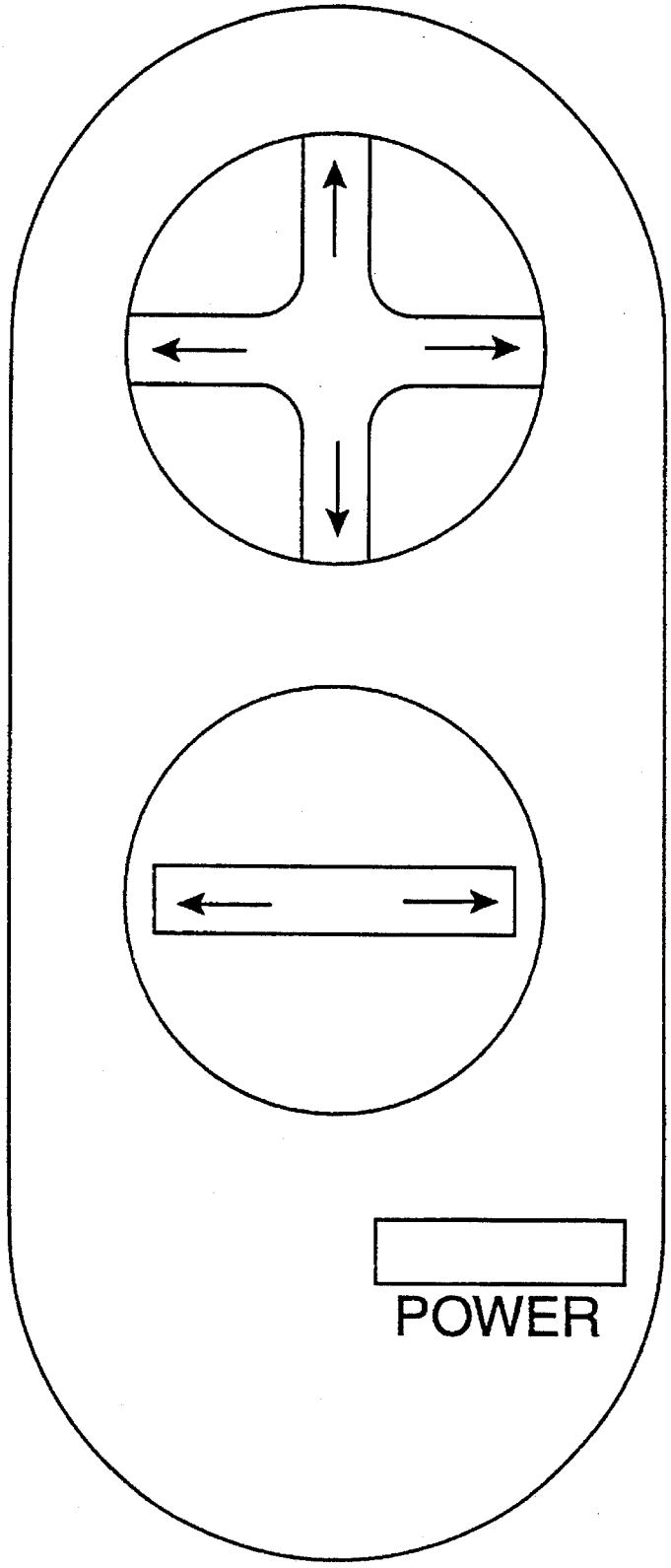
FIG. 12 shows an optional hand-held remote control device for operating the press brake controller positioning system.

Alternatively, the left and right movement of the lower controller positioning subsystem can be controlled by a hand-operated remote control device 56, shown in FIG. 12. The remote control device 56 can be handheld or it can be made with a clip or other means for attaching it to the belt or clothing of the press operator so that it does not unnecessarily occupy one of the operator's hands. The remote control device 56 can transmit the control signals to a receiver on the lower controller positioning subsystem 24 by infrared or radiofrequency signal transmission.

FIGS. 4, 5, 6 and 7 show the internal mechanisms of the first embodiment of the lower controller positioning subsystem 24. A pneumatic cylinder 58 is mounted within the housing 48. Preferably the pneumatic cylinder 58 is a magnetically coupled rodless cylinder, such as a FESTO DGO Rodless Cylinder, although other types of pneumatic cylinders or rodless pneumatic cylinders known in the industry may be used. The rodless cylinder 58 has a tubular cylinder 60 which runs substantially the full length of the housing 48. A magnetic piston (not seen) rides within the cylinder 60. The piston is driven frown one end of the cylinder to the other by pneumatic pressure which is delivered to the ends of the cylinder 60. A yoke 62 rides on the exterior of the cylinder 60. The yoke 62 is magnetically coupled to the piston so that it follows the piston as it travels from one end of the cylinder 60 to the other. The control pedals 34 and the safety guard 36 are bolted to the yoke so that they travel back and forth along the cylinder 60 in response to the movement of the piston. The control pedals 34 and the safety guard 36 roll along the floor on the ball casters 50.

The use of the magnetically coupled rodless cylinder 58 has a number of advantages in the present application. Using a rodless cylinder allows the lower controller positioning subsystem 24 to be designed so that the control pedals 34 can move substantially the full length of the housing 48 which holds the subsystem 24 without the need for additional length to accommodate the rod in a standard pneumatic cylinder. This creates a very compact design for the lower controller positioning subsystem 24. The choice of a magnetically coupled rodless cylinder over a cable or belt operated rodless cylinder or a standard pneumatic cylinder makes the lower controller positioning subsystem 24 cleaner, more reliable and lower maintenance to operate because there are no seals to wear out or leak, no rods to bend, and no belt or cable to snap, stretch or need adjustment. The magnetic coupling also serves an important safety function in the lower controller positioning subsystem 24. The strength of the coupling between the yoke 62 and the piston within the cylinder 60 is adjustable by changing the proximity of the magnets in the coupling. This allows the designer or the operator to adjust the breakaway force between the yoke 62 and the piston so that if the operator's foot or a piece of equipment gets in the way of the moving control pedal 34, the control pedal 34 will decouple and stop moving, rather than exerting undue force on the obstacle which could cause damage or injury. The magnetic coupling between the yoke 62 and the piston is easily reestablished by returning the piston to the approximate position where the breakaway occurred.

Figure 6:
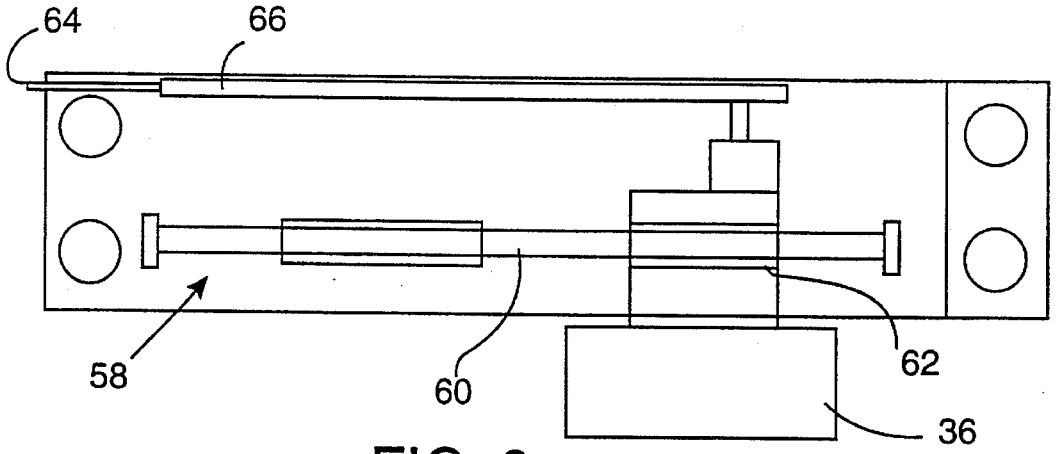
FIG. 6 is a cutaway top view of the first embodiment of the lower controller positioning subsystem.
Figure 7:
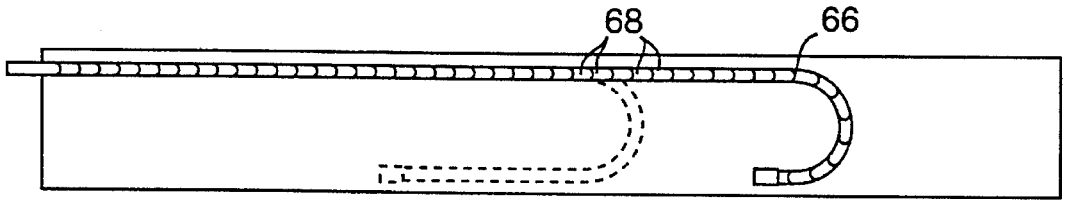
FIG. 7 illustrates the flexible cable housing of the first embodiment of the lower controller positioning subsystem.

The control cable 64 which connects the control pedals 34 to the press brake 20 is protected in a flexible cable guard 66, seen from the top in FIG. 6 and from the front in FIG. 7 with the other components of the subsystem 24 removed for clarity. The flexible cable guard 66 is made up of multiple hollow plastic links 68 that are pivotally connected together like a chain. The control cable 64 rides in the hollow space within the flexible cable guard 66. The end of the control cable 64 is connected to the control pedal 34 at the end of the flexible cable guard 66. The geometry of the links 68 in the flexible cable guard 66 allow the cable guard to flex as it follows the movement of the control pedal 34. The flexible cable guard 66 maintains a fixed diameter bend in the control cable 64 as it flexes, as shown by the phantom lines 64' in FIG. 7. This helps to prevent kinking or fatigue in the control cable 64 as it flexes.

Figure 8:
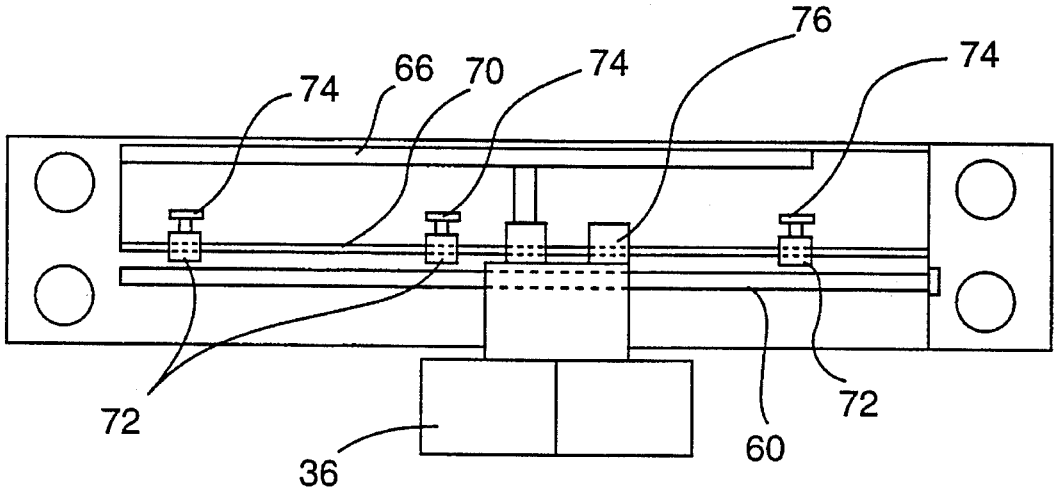
FIG. 8 is a cutaway top view of a variation of the first embodiment of the lower controller positioning subsystem.

FIG. 8 is a cutaway top view showing a variation of the first embodiment of the lower controller positioning subsystem 24. This variation is designed to facilitate programmable operation of the press brake controller positioning system. A rod 70 is mounted in the housing 48 parallel with the rodless cylinder 58. Multiple proximity indicators 72 are movably mounted on the rod 72. Each proximity indicator 72 has a set screw 74 which can be loosened to move the proximity indicator 72 along the rod 70 or tightened to lock it in place. A proximity detector 76 is mounted on the yoke 62 or other moving component to sense each of the proximity indicators 72 as the control pedal 34 passes. The proximity detector 76 can be a magnetic proximity detector, in which case each of the proximity indicators 72 would include a piece of magnetic material, or an optical proximity detector, in which case the proximity indicators 72 would interrupt a beam of light in the proximity detector 76 as it passes. Alternatively, the proximity indicators 72 could be replaced with a series of microswitches that would be tripped as the control pedal 34 passes.

In any case, the proximity indicators 72 would each be positioned along the rod 70 to indicate the proper position for the control pedal 34 to stop at one of the forming stations along the length of the press brake 20. The press brake controller positioning system can thus be programmed to stop the control pedal 34 at each forming station for a predetermined period of time or to wait for a signal from the operator that the operation has been completed at that forming station and the control pedal 34 should move on to the next forming station. Other schemes can be used for performing this function of the press brake controller positioning system. For instance, a position detector, such as an optical or magnetic position detector can be used to detect the position of the yoke 62 and the control pedal 34 all along the cylinder 60. Rather than placing proximity indicators, the operator would program the desired forming station positions into the control system and the system would stop the control pedal 34 at each desired location along its travel. A pneumatic cylinder incorporating a magnetic position detector suitable for this application is described in U.S. Pat. No. 4,471,304, the specification of which is hereby incorporated in its entirety.

Figure 9:
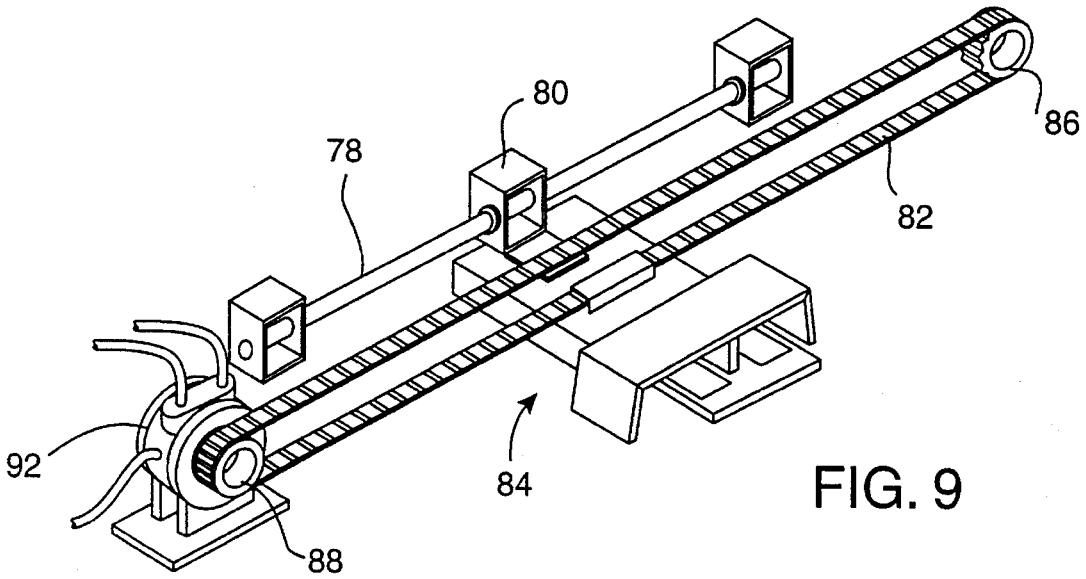
FIG. 9 is a perspective view of a second embodiment of the lower controller positioning subsystem of the press brake controller positioning system.
Figure 10:
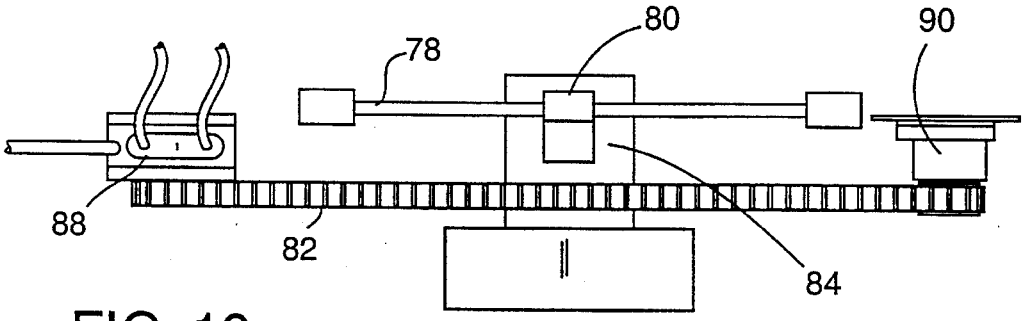
FIG. 10 is a top view of the second embodiment of the lower controller positioning subsystem.
Figure 11:
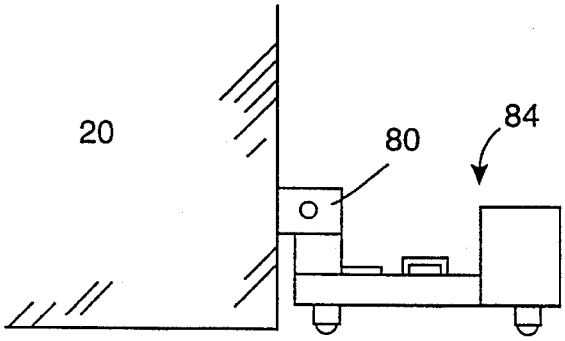
FIG. 11 is a side view of the second embodiment of the lower controller positioning subsystem.

FIGS. 9, 10 and 11 show the internal mechanisms of a second embodiment of the lower controller positioning subsystem 24 of the press brake controller positioning system of the present invention. In this embodiment, the control pedals 34 are connected to a linear bearing 80 which is slidably mounted on a rod 78. The rod 78 may be mounted directly on the front of the press brake 20, as shown in FIG. 11, or it may be mounted in a freestanding housing, as shown in the previously described embodiments. The control pedals 34 and the safety guard 36 roll along the shop floor on ball casters 50, as in the previous embodiments. A drive chain 82 or a cog belt is connected to the pedal housing 84. The drive chain 82 is in a loop that runs over two sprockets 86, 88 or pulleys. The first sprocket 86 is an idler sprocket connected to a chain tensioner 90 that keeps the drive chain 82 taut along the front of the press brake 20. The second sprocket 88 is a drive sprocket which is coupled to a motor 92. The motor 92 can be a pneumatically driven motor, as illustrated in FIGS. 9 and 10, or it can be an electric motor, including AC motors, DC motors and stepper motors. When the motor 92 is activated by pneumatic pressure (or an electrical current if an electric motor is used), the drive sprocket 88 turns which moves the drive chain 82 left or right to move the control pedal 34 from station to station along the front of the press brake 20 or similar metal forming equipment.

As in the previously described embodiments, this second embodiment of the lower controller positioning subsystem of the press brake controller positioning system can be made so that it is manually operated by control switches or a remote control device or it can be integrated into an automated or programmable controller positioning system. Proximity indicators or linear or rotary position detectors could be provided for sensing and controlling the position of the control pedals along the press brake.

Although the foregoing examples include many specificities, they are intended as illustrative of only some of the possible embodiments of the present invention. Other embodiments and modifications will, no doubt, occur to those skilled in the art. For example, although the present invention has been described with specific reference to a hydraulic press brake, it could easily be modified to be used with other types of metal forming equipment, such as a hydraulic sheet metal shear or a deep drawing press with multiple stations for progressive die forming operations. Also, if desired, the mechanisms that have been described for the lower controller positioning subsystem could be equally applied to the upper controller positioning subsystem for moving the tonnage controller or other machine controls. Thus, the examples given should only be interpreted as illustrations of some of the preferred embodiments of the invention, and the full scope of the invention should be determined by the appended claims and their legal equivalents.

We claim:

1. A controller positioning system for use with a piece of equipment having a user-operated controller having an interface for manually inputting parameters to control the piece of equipment, said piece of equipment having a length, said controller positioning system comprising:

a guide means for guiding said user-operated controller along at least a portion of the length of said piece of equipment, a powered means for moving said user-operated controller along said guide means, and a control means for controlling the movement of said user-operated controller along said guide means.

2. The controller positioning system of claim 1 wherein said piece of equipment comprises a press brake for forming sheet metal parts and said controller positioning system is configured to move said user-operated controller along at least a portion of the length of said press brake.

3. The controller positioning system of claim 1 wherein said piece of equipment has a plurality of work stations along the length of said piece of equipment and said controller positioning system is configured to move said user-operated controller from work station to work station along the length of said piece of equipment.

4. The controller positioning system of claim 1 wherein said user-operated controller comprises at least one control pedal and said controller positioning system is configured to move said control pedal along at least a portion of the length of said piece of equipment.

5. The controller positioning system of claim 1 wherein said user-operated controller comprises at least one hand-operated control and said controller positioning system is configured to move said hand-operated control along at least a portion of the length of said piece of equipment.

6. The controller positioning system of claim 1 wherein said means for moving said user-operated controller comprises a pneumatic cylinder configured to move said user-operated controller along at least a portion of the length of said piece of equipment.

7. The controller positioning system of claim 1 wherein said means for moving said user-operated controller comprises a rotary motor which is coupled to a chain or belt configured to move said user-operated controller along at least a portion of the length of said piece of equipment.

8. The controller positioning system of claim 1 further comprising means for moving said user-operated controller closer to or farther away from said piece of equipment.

9. The controller positioning system of claim 1 wherein said control means includes a programmable means for controlling said means for moving said user-operated controller to position said user-operated controller at selected positions along the length of said piece of equipment.

10. The controller positioning system of claim 1 wherein said control means includes at least one user-operated switch for controlling said means for moving said user-operated controller to position said user-operated controller at selected positions along the length of said piece of equipment.

11. A controller positioning system for use with a piece of equipment having a user-operated controller, said piece of equipment having a length, said controller positioning system comprising:

a guide means for guiding said controller along at least a portion of the length of said piece of equipment, a powered means for moving said controller along said guide means, and a control means for controlling the movement of said controller along said guide means, wherein said means for moving said controller comprises a pneumatic cylinder having a piston slidably received within said pneumatic cylinder, said pneumatic cylinder extending at least a portion of the length of said piece of equipment, and said guide means comprises a yoke configured to slide along an exterior surface of said pneumatic cylinder and a coupling means for coupling said yoke to said piston such that said yoke follows the movement of said piston as said piston moves within said pneumatic cylinder, said controller being connected to said yoke such that said controller follows the movement of said piston as said piston moves within said pneumatic cylinder.

12. The controller positioning system of claim 11 wherein said coupling means comprises a magnetic coupling between said piston and said yoke.

13. The controller positioning system of claim 11 wherein said coupling means has a threshold breakaway force such that when a force such that when a force greater than said threshold breakaway force is exerted on said yoke or on said controller said yoke decouplers from said piston.

14. A controller positioning system for use with a piece of equipment having a user-operated controller said piece of equipment having a length, said controller positioning system comprising:

a guide means for guiding said controller along at least a portion of the length of said piece of equipment, a powered means for moving said controller along said guide means, and a control means for controlling the movement of said controller along said guide means, further comprising a remote control transmitter for transmitting control signals to a receiver which delivers said control signals to said control means.

15. In combination:

a press brake for forming sheet metal parts, said press brake having a length, a control pedal for operating said press brake, a guide means for guiding said control pedal along at least a portion of the length of said press brake, a powered means for moving said control pedal along said guide means, and a control means for controlling the movement of said control pedal along said guide means.

16. The combination of claim 15 wherein said press brake has a plurality of work stations along the length of said press brake and said control means controls said means for moving said control pedal to move said control pedal from work station to work station along the length of said press brake.

17. A control pedal positioning system for use with a piece of equipment having a control pedal, said piece of equipment having a length, said control pedal positioning system comprising:

a pneumatic cylinder having a piston slidably received within said pneumatic cylinder, said pneumatic cylinder extending at least a portion of the length of said piece of equipment, a yoke configured to slide along an exterior surface of said pneumatic cylinder, a coupling means for coupling said yoke to said piston such that said yoke follows the movement of said piston as said piston moves within said pneumatic cylinder, said control pedal being connected to said yoke such that said control pedal follows the movement of said piston as said piston moves within said pneumatic cylinder, and a control means for controlling the movement of said piston within said pneumatic cylinder to position said control pedal at selected positions along the length of said piece of equipment.

18. The control pedal positioning system of claim 17 wherein said coupling means comprises a magnetic coupling between said piston and said yoke.

19. The control pedal positioning system of claim 17 wherein said piece of equipment comprises a press brake for forming sheet metal parts and said control pedal positioning system is configured to move said control pedal along at least a portion of the length of said press brake.

20. A control pedal positioning system for use with a piece of equipment having a control pedal, said piece of equipment having a length, said control pedal positioning system comprising:

a guide rail extending along at least a portion of the length of said piece of equipment, a linear bearing slidably engaging said guide rail, said control pedal being connected to said linear bearing such that said control pedal is slidable along said guide rail, a motor, said motor being coupled to a first sprocket or pulley, a chain or belt running from said first sprocket or pulley to a second sprocket or pulley, said chain or belt running approximately parallel to said guide rail between said first sprocket or pulley and said second sprocket or pulley, said control pedal being connected to said chain or belt such that when said motor rotates said first sprocket or pulley said chain or belt moves said control pedal along said guide rail along at least a portion of the length of said piece of equipment.

21. The control pedal positioning system of claim 20 wherein said motor comprises a pneumatic motor.

22. The control pedal positioning system of claim 20 wherein said motor comprises an electric motor.

23. The control pedal positioning system of claim 20 wherein said piece of equipment comprises a press brake for forming sheet metal parts and said control pedal positioning system is configured to move said control pedal along at least a portion of the length of said press brake.

* * * * *